US009401110B2

(12) United States Patent
Lee et al.

(10) Patent No.: US 9,401,110 B2
(45) Date of Patent: Jul. 26, 2016

(54) ORGANIC LIGHT EMITTING DISPLAY AND DEGRADATION COMPENSATION METHOD THEREOF

(71) Applicant: LG Display Co., Ltd., Seoul (KR)

(72) Inventors: Jiwon Lee, Paju-si (KR); Seonggyun Kim, Gunpo-si (KR)

(73) Assignee: LG Display Co., Ltd., Seoul (KR)

( * ) Notice: Subject to any disclaimer, the term of this patent is extended or adjusted under 35 U.S.C. 154(b) by 186 days.

(21) Appl. No.: 14/053,899

(22) Filed: Oct. 15, 2013

(65) Prior Publication Data

US 2014/0160142 A1 Jun. 12, 2014

(30) Foreign Application Priority Data

Dec. 10, 2012 (KR) ..... 10-2012-0142502

(51) Int. Cl.
*G09G 3/3208* (2016.01)
*G09G 3/32* (2016.01)

(52) U.S. Cl.
CPC ..... *G09G 3/3208* (2013.01); *G09G 2320/0233* (2013.01); *G09G 2320/0276* (2013.01); *G09G 2320/0295* (2013.01); *G09G 2320/045* (2013.01); *G09G 2320/046* (2013.01); *G09G 2320/0686* (2013.01); *G09G 2360/16* (2013.01)

(58) Field of Classification Search
None
See application file for complete search history.

(56) References Cited

U.S. PATENT DOCUMENTS

2008/0055210 A1* 3/2008 Cok ..... 345/77
2010/0007656 A1* 1/2010 Okamoto ..... G09G 3/3233 345/214

FOREIGN PATENT DOCUMENTS

| | | |
|---|---|---|
| CN | 101625826 A | 1/2010 |
| KR | 2011-0057531 | 6/2011 |
| KR | 2011-0057534 | 6/2011 |
| KR | 2011-0066506 | 6/2011 |

* cited by examiner

*Primary Examiner* — Barry Drennan
*Assistant Examiner* — Richard M Russell
(74) *Attorney, Agent, or Firm* — Dentons US LLP

(57) ABSTRACT

An organic light emitting display includes a display panel including a plurality of pixels, a compensation area setting unit for selecting an additional compensation requirement area, that is more excessively degraded than an average degradation, based on degradation detection data indicating a degradation degree of organic light emitting diodes formed in the pixels, an edge information extraction unit that analyzes input image data corresponding to the additional compensation requirement area and obtains edge information of an input image, a compensation gain calculation unit for differentially calculating a compensation gain to be applied to compensation data in each of the compensation blocks belonging to the additional compensation requirement area based upon an amount of edge information; and a data modulation unit producing modulation image data to be displayed on the display panel.

15 Claims, 10 Drawing Sheets

| | | |
|---|---|---|
| −1 | 0 | 1 |
| −2 | 0 | 2 |
| −1 | 0 | 1 |

FIG. 10

| | Luminance percentage based on compensation image |
|---|---|
| Area1 | 97.255 |
| Area2 | 98.039 |
| Area3 | 87.059 |

ORGANIC LIGHT EMITTING DISPLAY AND DEGRADATION COMPENSATION METHOD THEREOF

This application claims the benefit of Korean Patent Application No. 10-2012-0142502 filed on Dec. 10, 2012, which is incorporated herein by reference for all purposes as if fully set forth herein.

BACKGROUND OF THE INVENTION

1. Field of the Invention

The present invention relates to an organic light emitting display and more particularly to an organic light emitting display and a degradation compensation method thereof capable of compensating for degradation of an organic light emitting diode.

2. Discussion of the Related Art

An organic light emitting display, which has been considered as the next generation display, includes a self-emitting element capable of emitting light by itself. Thus, the organic light emitting display has advantages of fast response time, high light emitting efficiency, high luminance, wide viewing angle, etc.

The organic light emitting display includes an organic light emitting diode (hereinafter, abbreviated to "OLED") serving as the self-emitting element. The OLED includes an anode electrode, a cathode electrode, and an organic compound layer formed between the anode electrode and the cathode electrode. The organic compound layer includes a hole injection layer, a hole transport layer, a light emitting layer, an electron transport layer, and an electron injection layer. When a driving voltage is applied to the anode electrode and the cathode electrode, holes passing through the hole transport layer and electrons passing through the electron transport layer move to the light emitting layer and form excitons. As a result, the light emitting layer generates visible light.

In the organic light emitting display, pixels each include an OLED are arranged in a matrix form, and brightness of the pixels is controlled based on a gray level of video data. The organic light emitting display is mainly classified as a passive matrix organic light emitting display or an active matrix organic light emitting display using thin film transistors (TFTs) as a switching element. The active matrix organic light emitting display selectively turns on the TFTs serving as an active element to select the pixel and holds the light emission of the pixels using a hold voltage of a storage capacitor.

There are several factors to reduce the luminance uniformity between the pixels in the organic light emitting display. For example, a deviation between electrical characteristics of driving TFTs of the pixels, a deviation between cell driving voltages of the pixels, a degradation deviation between the OLEDs of the pixels, etc. have been known as the factors. Among these factors, the degradation deviation between the OLEDs leads to an image sticking phenomenon, thereby reducing image quality of the organic light emitting display.

The OLED is degraded by use over a period of time, and thus reduces a display luminance of the organic light emitting display. A degradation degree of the OLED is affected by brightness of an input image. A degradation degree of the OLED mainly displaying a bright image is greater than a degradation degree of the OLED mainly displaying a dark image. Degradation degrees of elements on an organic light emitting display panel are partially different from one another. When the degradation is generated in the organic light emitting display as described above, a related art organic light emitting display compensates for a luminance depending on the degradation degree and uniformly adjusts a display luminance of one screen. The related art increases an amount of current flowing in the OLED in proportion to the degradation degree, thereby compensating for the luminance. Therefore, the related art imposes a strain on a degraded area and accelerates the degradation. In the related art, because an amount of current applied to the element, in which the degradation is accelerated, has to increase, the degradation of the organic light emitting display is accelerated. Hence, life span of the organic light emitting display is further reduced.

SUMMARY OF THE INVENTION

Accordingly, the present invention is directed to an organic light emitting display and a degradation compensation method thereof capable of reducing a difference between degradation speeds of all of organic light emitting diodes on a display panel.

In one aspect, there is an organic light emitting display comprising a display panel including a plurality of pixels each having an organic light emitting diode, the display panel displaying an image, a compensation area setting unit configured to select an additional compensation requirement area, which is more excessively degraded than an averagely degraded area, based on degradation detection data indicating a degradation degree of the organic light emitting diode, an edge information extraction unit configured to analyze input image data corresponding to the additional compensation requirement area and obtain edge information of an input image, a compensation gain calculation unit configured to calculate a compensation gain to be applied to compensation data in each of compensation blocks belonging to the additional compensation requirement area depending on an amount of edge information, and a data modulation unit configured to multiply the compensation data of each pixel, to which the compensation gain is applied, by the input image data and produce modulation image data to be displayed on the display panel.

In another aspect, there is a degradation compensation method of an organic light emitting display having a display panel which includes a plurality of pixels and displays an image, the degradation compensation method comprising selecting an additional compensation requirement area, which is more excessively degraded than an averagely degraded area, based on degradation detection data indicating a degradation degree of organic light emitting diodes formed in the pixels, analyzing input image data corresponding to the additional compensation requirement area and obtaining edge information of an input image, differentially calculating a compensation gain to be applied to compensation data in each of compensation blocks belonging to the additional compensation requirement area depending on an amount of edge information, and multiplying the compensation data of each pixel, to which the compensation gain is applied, by the input image data and producing modulation image data to be displayed on the display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 10 illustrates a luminance percentage based on a compensation image in each of additional compensation requirement areas Area1, Area2, and Area3 shown in FIG. 9.

DETAILED DESCRIPTION OF THE ILLUSTRATED EMBODIMENTS

Reference will now be made in detail to embodiments of the invention, examples of which are illustrated in the accompanying drawings. Wherever possible, the same reference numbers will be used throughout the drawings to refer to the same or like parts.

Exemplary embodiments of the invention are described below with reference to FIGS. 1 to 11.

Figure 1:
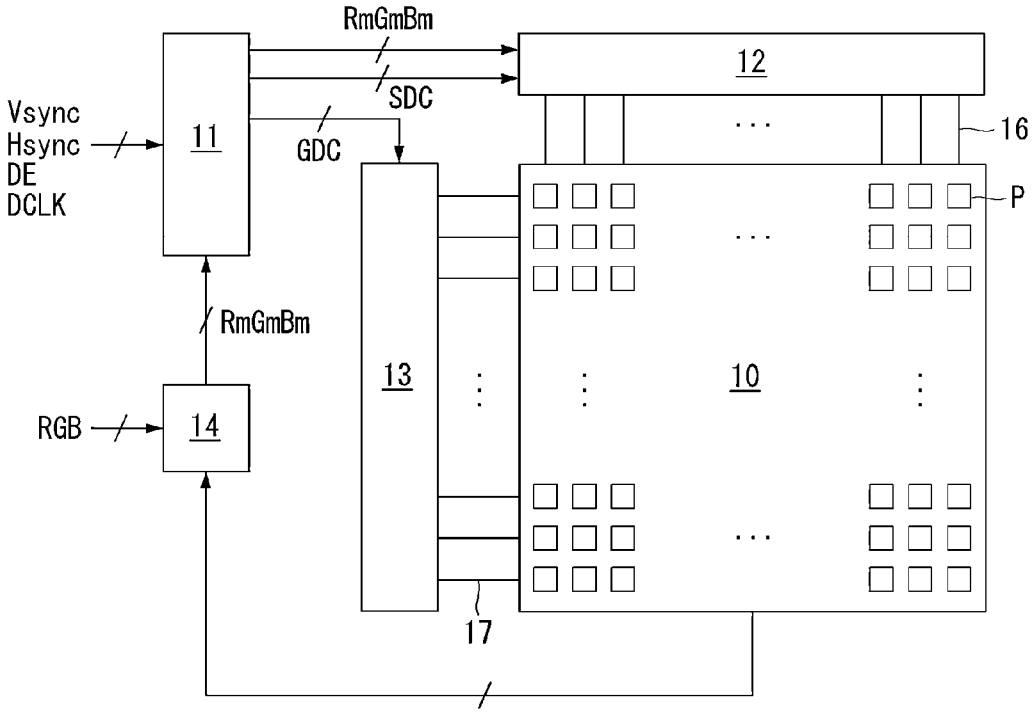
FIG. 1 illustrates an organic light emitting display according to an exemplary embodiment of the invention.
Figure 2:
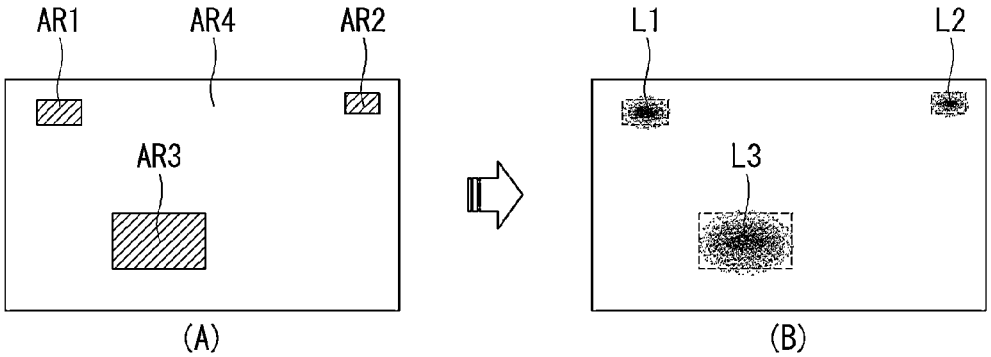
FIG. 2 illustrates additional compensation requirement areas selected based on degradation detection data and a compensation luminance implemented in the additional compensation requirement areas.

FIG. 1 illustrates an organic light emitting display according to an exemplary embodiment of the invention. FIG. 2 illustrates additional compensation requirement areas selected based on degradation detection data and a compensation luminance implemented in the additional compensation requirement areas.

As shown in FIG. 1, an organic light emitting display according to an exemplary embodiment of the invention and includes a display panel 10 on which pixels P are formed in a matrix form, a data driving circuit 12 for driving data lines 16 of the display panel 10, a gate driving circuit 13 for driving gate lines 17 of the display panel 10, a timing controller 11 for controlling operations of the driving circuits 12 and 13, and a degradation compensation circuit 14 which modulates input image data RGB and compensates for a reduction in a luminance resulting from degradation of organic light emitting diodes (hereinafter, abbreviated to "OLEDs").

The display panel 10 includes a plurality of data lines 16, a plurality of gate lines 17 crossing the data lines 16, and a plurality of pixels P respectively positioned at crossings of the data lines 16 and the gate lines 17. The plurality of gate lines 17 may include scan pulse supply lines for the supply of a scan pulse, emission pulse supply lines for the supply of an emission pulse, and sensing pulse supply lines for the supply of a sensing pulse. The plurality of gate lines 17 may further include initialization voltage supply lines for supplying an initialization voltage based on a structure of a pixel circuit and reference voltage supply lines for supplying a reference voltage. Each pixel P is connected to the data driving circuit 12 through the data lines 16 and is connected to the gate driving circuit 13 through the gate lines 17.

Each pixel P may include an OLED, a driving thin film transistor (TFT) for controlling an amount of driving current flowing in the OLED based on a data voltage, at least one switching TFT, a storage capacitor, etc. Each pixel P may have any known structure as long as it can sense the degradation of the OLED. For example, the pixel P may be designed to have the same structure as a pixel disclosed in detail in Korean Patent Application Nos. 10-2009-0113974 (Nov. 24, 2009), 10-2009-0113979 (Nov. 24, 2009), and 10-2009-0123190 (Dec. 11, 2009) corresponding to the present applicant, and which are hereby incorporated by reference in their entirety. Because a threshold voltage of the OLED increases as the degradation of the OLED is progressed, a degradation degree of the OLED may be found through the detection of the threshold voltage of the OLED. As the threshold voltage of the OLED increases, the OLED requires a current more than an initial current so as to represent the same brightness. The threshold voltage of the OLED sensed from the pixel P is degradation detection data.

The timing controller 11 receives timing signals, such as a vertical sync signal Vsync, a horizontal sync signal Hsync, a dot clock DCLK, and a data enable signal DE, from a system board (not shown) and generates a source control signal SDC for controlling operation timing of the data driving circuit 12 and a gate control signal GDC for controlling operation timing of the gate driving circuit 13 based on the timing signals Vsync, Hsync, DCLK, and DE.

The timing controller 11 receives modulation image data RmGmBm for the degradation compensation from the degradation compensation circuit 14 and arranges the modulation image data RmGmBm suitably for the display panel 10. The timing controller 11 supplies the arranged modulation image data RmGmBm to the data driving circuit 12. The timing controller 11 may produce programming data to be applied to the pixels P in a degradation sensing period of the OLEDs of the pixels P and may supply the programming data to the data driving circuit 12. The programming data to be applied to the pixels P may be selected as a value suitable to sense the threshold voltage of the OLEDs.

The timing controller 11 may separately set an image display period, in which a display image is implemented in a state where a deviation between the degradation degrees of the OLEDs is corrected, and a degradation sensing period, in which the threshold voltage of the OLEDs is sensed. The degradation sensing period may be set to at least one frame period synchronized with on-timing of a driving power source or at least one frame period synchronized with off-timing of the driving power source. The degradation sensing period may be set to a vertical blank period assigned between every two image display periods. The timing controller 11 may differently control operations of the data driving circuit 12 and the gate driving circuit 13 in the image display period and the degradation sensing period.

During the image display period, the data driving circuit 12 converts the modulation image data RmGmBm into the data voltage under the control of the timing controller 11 and supplies the data voltage to the data lines 16. During the degradation sensing period, the data driving circuit 12 converts the programming data received from the timing controller 11 into a programming voltage under the control of the timing controller 11 and supplies the programming voltage to the data lines 16.

The gate driving circuit 13 includes a shift register and a level shifter and generates the scan pulse, the sensing pulse, and the emission pulse under the control of the timing controller 11. The scan pulse is applied to the scan pulse supply lines, the emission pulse is applied to the emission pulse supply lines, and the sensing pulse is applied to the sensing pulse supply lines. The shift register constituting the gate driving circuit 13 may be directly formed on the display panel 10 in a Gate-In-Panel (GIP) manner.

The degradation compensation circuit 14 selects an area (i.e., additional compensation requirement areas AR1, AR2, and AR3 shown in (A) of FIG. 2) having a degradation degree much greater than an average (hereinafter referred to as "average degradation") of the degradation degrees based on the degradation detection data received from the display panel 10. The degradation compensation circuit 14 analyzes input image data corresponding to the additional compensation requirement areas AR1, AR2, and AR3 and obtains edge information of each of the compensation blocks included in each of the additional compensation requirement areas AR1, AR2, and AR3. The degradation compensation circuit 14 differentially calculates compensation gains of the compensation blocks to be applied to compensation data depending on an amount of edge information. The degradation compensation circuit 14 multiplies the compensation data, to which the compensation gain is differentially applied, by input image data RGB and outputs the modulation image data RmGmBm. As shown in (B) of FIG. 2, the degradation compensation circuit 14 sets compensation luminances L1, L2, and L3 of the additional compensation requirement areas AR1, AR2, and AR3 to be less than an original compensation luminance (i.e., the compensation luminance obtained when the compensation gain is set to '1') within a unrecognizable range, thereby reducing the degradation speed of the OLEDs. When an image to be displayed in the additional compensation requirement areas AR1, AR2, and AR3 is a complex image having many edges, the degradation compensation circuit 14 relatively reduces the compensation gain within the range less than '1' because a reduction in local luminance of the image is not conspicuous. Thus, the degradation compensation circuit 14 greatly reduces the compensation luminance based on the original compensation luminance. On the other hand, when an image to be displayed in the additional compensation requirement areas AR1, AR2, and AR3 is a flat image scarcely having an edge, the degradation compensation circuit 14 relatively increases the compensation gain within the range less than '1' because a reduction in luminance of the image is conspicuous. Thus, the degradation compensation circuit 14 slightly reduces the compensation luminance based on the original compensation luminance. The degradation compensation circuit 14 may be embedded in the timing controller 11.

Figure 3:
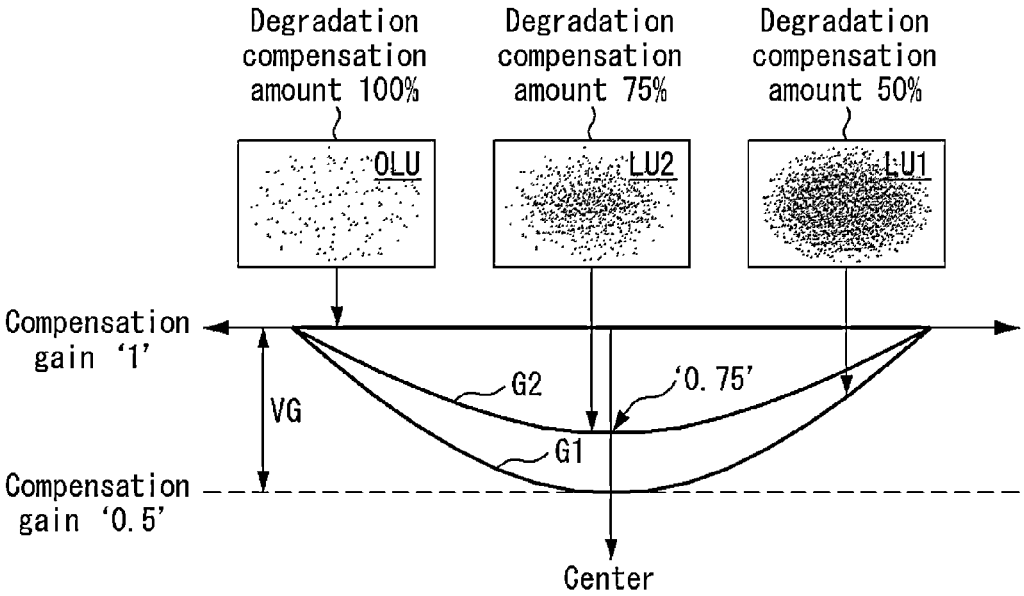
FIG. 3 illustrates a compensation amount of degradation and a compensation luminance depending on a compensation gain.

FIG. 3 illustrates a compensation amount of degradation and a compensation luminance depending on a compensation gain.

The compensation gain is a gain value for additionally adjusting compensation data calculated based on the degradation detection data. As shown in FIG. 3, the compensation gains of the compensation blocks according to the embodiment of the invention may be differentially calculated within a range VG less than '1' depending on the complexity of an image to be displayed on each compensation block of the additional compensation requirement area. FIG. 3 shows that the adjustment range VG of the compensation gain is 0.5 to 1. Other adjustment ranges may be used in the embodiment of the invention. The compensation gain of '1' indicates that a compensation amount of degradation is 100%. The compensation gain of '1' is applied to an area AR4 other than the additional compensation requirement areas AR1, AR2, and AR3 shown in FIG. 2.

A compensation gain curve G1 shown in FIG. 3 has a compensation gain of '0.5' at its center and implements a compensation amount of degradation of 50%. A compensation luminance LU1 based on the compensation gain curve G1 is much less than an original compensation luminance OLU obtained when the compensation gain is '1'. Because the complex image having the many edges is displayed on the compensation blocks, to which the compensation gain curve G1 is applied, the luminance reduction is not conspicuous even if the local luminance is greatly reduced. When the compensation data is lowered using the relatively very small compensation gain, a stress the OLED feels is greatly reduced. Hence, it is very effective in an increase in life span of the organic light emitting display.

A compensation gain curve G2 shown in FIG. 3 has a compensation gain of '0.75' at its center and implements a compensation amount of degradation of 75%. A compensation luminance LU2 based on the compensation gain curve G2 is less than the original compensation luminance OLU obtained when the compensation gain is '1' and is greater than the compensation luminance LU1 based on the compensation gain curve G1. Because the flat image having the some edges is displayed on the compensation blocks, to which the compensation gain curve G2 is applied, the luminance reduction is conspicuous. Therefore, the embodiment of the invention causes a reduction width of the luminance in the compensation gain curve G2 to be less than that in the compensation gain curve G1. In this instance, the stress of the OLED is reduced, as compared to when the compensation gain is '1'.

Figure 4:
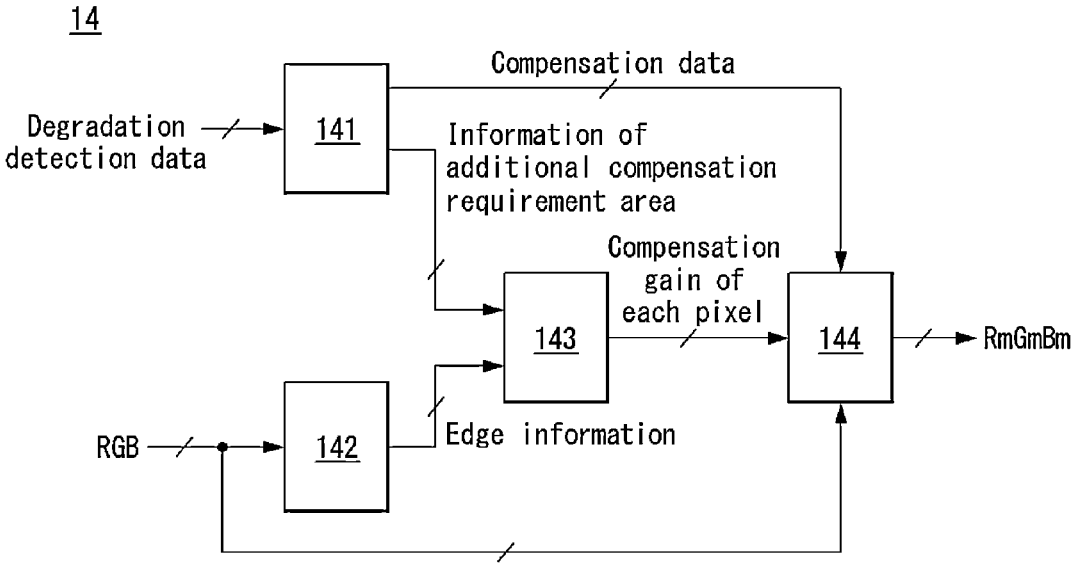
FIG. 4 illustrates a detailed configuration of a degradation compensation circuit.
Figures 5, 6:
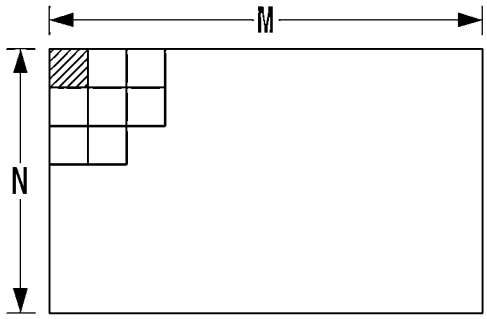
FIG. 5 illustrates an example of dividing a compensation image into a plurality of compensation blocks.
FIG. 6 illustrates an example of a Sobel mask.
Figure 7A:
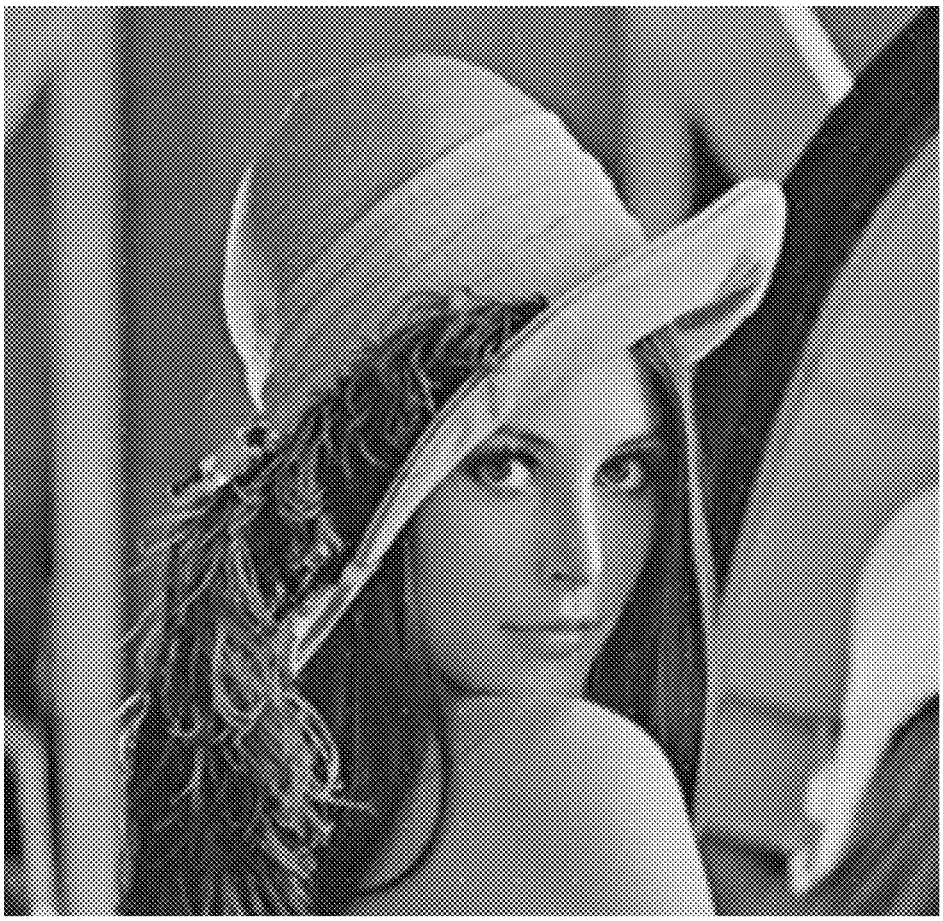
FIG. 7A illustrates an input image before a Sobel mask is applied.
Figure 7B:
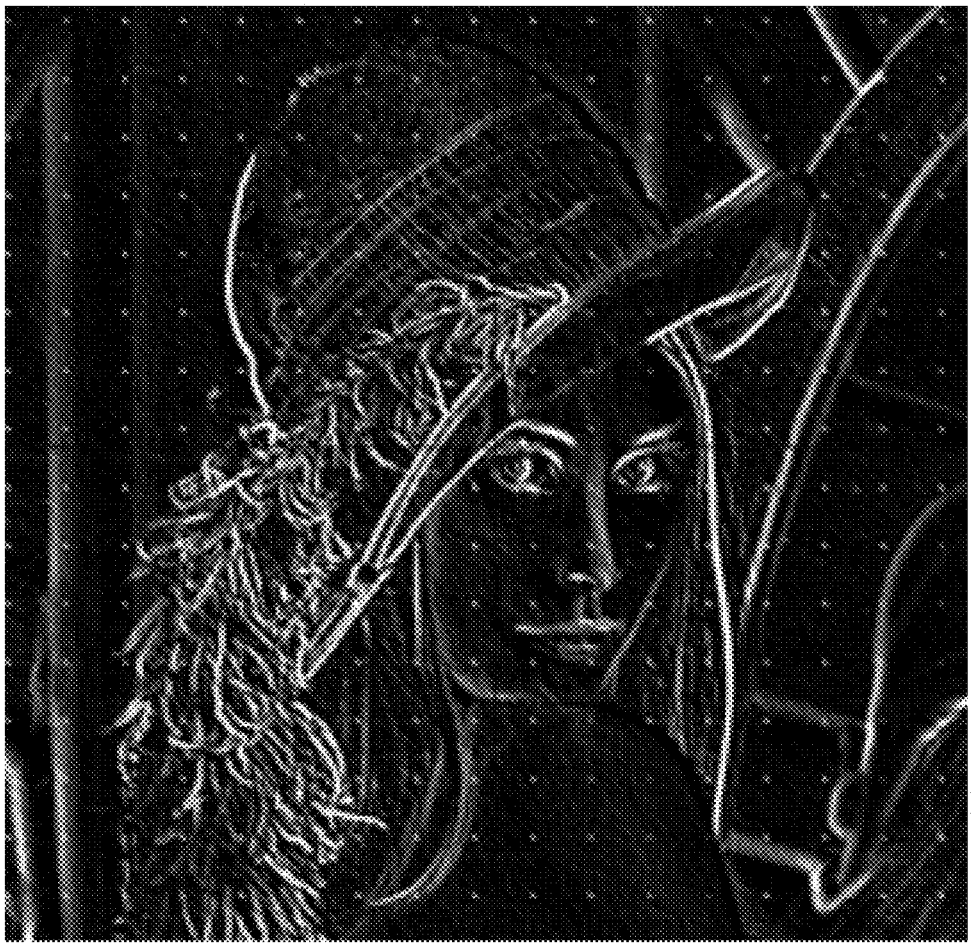
FIG. 7B illustrates edge information extracted by applying Sobel mask to an input image shown in FIG. 7A.
Figure 8:
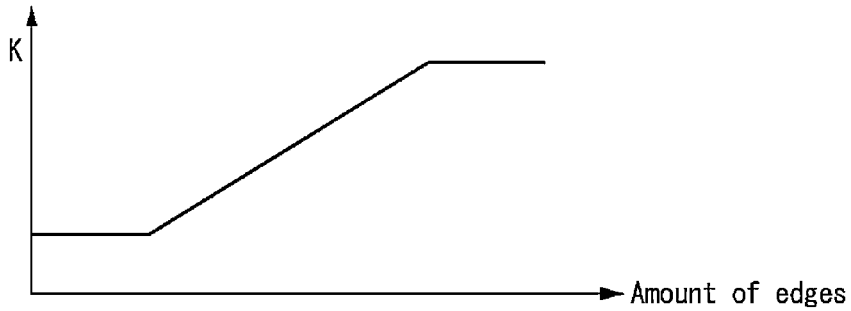
FIG. 8 illustrates a relationship between an amount of edge information and a scale constant.

FIG. 4 illustrates detailed configuration of the degradation compensation circuit 14. FIG. 5 illustrates an example of dividing a compensation image into a plurality of compensation blocks. FIG. 6 illustrates an example of a Sobel mask. FIG. 7A illustrates an input image before the Sobel mask is applied, and FIG. 7B illustrates edge information extracted by applying the Sobel mask to the input image shown in FIG. 7A. FIG. 8 illustrates a relationship between an amount of edge information and a scale constant.

As shown in FIG. 4, the degradation compensation circuit 14 includes a compensation area setting unit 141, an edge information extraction unit 142, a compensation gain calculation unit 143, and a data modulation unit 144.

The compensation area setting unit 141 receives degradation detection data (i.e., a sensing threshold voltage) indicating degradation degrees of the OLEDs from the display panel 10. The compensation area setting unit 141 calculates compensation data of each pixel for compensating for a luminance of each of the pixels included in the display panel 10 based on the degradation detection data. As shown in FIG. 5, the compensation area setting unit 141 divides a compensation image implemented by the compensation data into M*N compensation blocks, where M and N are a natural number. The compensation area setting unit 141 finds an average picture level (hereinafter, abbreviated to "APL") indicating an average brightness of each of the compensation blocks. Because the compensation data applied to the compensation block, which is excessively degraded, is greater than the compensation data applied to the compensation block, which is slightly degraded, an APL of the excessively degraded compensation block is greater than an APL of the slightly degraded compensation block. The compensation area setting unit 141 previously sets a reference APL and selects compensation blocks having an APL greater than the reference APL as an additional compensation requirement area for the adjustment of the compensation gain. The reference APL corresponds to brightness of the compensation block which is averagely degraded. The additional compensation requirement area indicates an area which is more excessively degraded than the averagely degraded compensation block. The compensation area setting unit 141 outputs information of the compensation blocks selected as the additional compensation requirement area from the compensation image.

The edge information extraction unit 142 analyzes input image data RGB and obtains edge information of the input image data RGB. The edge information extraction unit 142 obtains the edge information of the input image data RGB using J*J Sobel mask, where J is a natural number. For example, the edge information extraction unit 142 puts 3*3 Sobel mask shown in FIG. 6 on an input image shown in FIG. 7A and moves the 3*3 Sobel mask on the input image by one pixel in an x-axis direction. Each time the 3*3 Sobel mask is moved, the edge information extraction unit 142 multiplies nine weight values of the 3*3 Sobel mask by pixel values of nine pixels corresponding to the 3*3 Sobel mask, respectively and then obtains a sum of multiplication values, thereby detecting the edge information. After the detection of the edge information in the x-axis direction is completed, edge information in a y-axis direction is detected in the same manner as the x-axis direction. FIG. 7B illustrates edge information extracted by applying the Sobel mask to the input image shown in FIG. 7A. The edge information is applied when the compensation gain for the additional compensation is calculated, and serves as a factor for determining a value of the compensation gain.

The compensation gain calculation unit 143 differentially calculates compensation gains of the compensation blocks included in the additional compensation requirement area within the range less than '1' depending on an amount of edge information the additional compensation requirement area includes. An equation for obtaining the compensation gain is expressed by the following Equation 1.

$$G(M,N) = \max\left[1 - \frac{k \times (APL(M,N) - Ref.\ APL)}{2^i},\ Gmin\right] \quad \text{[Equation 1]}$$

In Equation 1, 'G(M,N)' is the compensation gain of each compensation block, 'k' is a scale constant, 'APL(M,N)' is an APL of each compensation block, '$2^i$' is a maximum gray representation value determined depending on the number 'i' of bits of the input image data RGB, 'Gmin' is a minimum value of the compensation gain G(M,N) which is previously set to a fixed value so as to prevent the distortion of the image, and Ref.APL is a reference APL. The reference APL corresponds to brightness of the averagely degraded area as described above and is previously set.

As shown in FIG. 8, the scale constant k of the above Equation 1 increases in proportion to an amount of edge information included in each compensation block. As the scale constant k increases, the compensation gain G(M,N) decreases. Therefore, an additional compensation luminance is reduced. The embodiment of the invention increases the scale constant k of the compensation block including much edge information and reduces the scale constant k of the compensation block including little edge information. Hence, the embodiment of the invention causes the compensation gain G(M,N) of the complex image to be less than the compensation gain G(M,N) of the flat image. When the compensation gain calculation unit 143 calculates the compensation gain of the compensation block, the compensation gain calculation unit 143 may additionally consider an average picture brightness of the input image to be displayed on the compensation block.

The compensation gain calculation unit 143 sets a compensation gain of each of compensation blocks (i.e., averagely degraded compensation blocks), which are not selected as the additional compensation requirement area in the compensation image, to '1'.

After the compensation gain of each compensation block is determined through the above-described process, the compensation gain calculation unit 143 applies Q*Q low pass filter to the compensation blocks, to which the compensation gain is applied, where Q is a natural number, for example, 5, thereby reducing a deviation between the compensation gains of the adjacent compensation blocks. When the low pass filtering is performed, the smoother image may be implemented. The compensation gain calculation unit 143 interpolates the compensation gain of each compensation block and calculates a compensation gain to be applied to each pixel. The embodiment of the invention may use any known interpolation method. When a linear interpolation method is used, the compensation gain to be applied to the pixel is determined depending on a position of the pixel in the compensation block to which the pixel belongs. The compensation gain calculation unit 143 divides each compensation block into four parts based on the linear interpolation method and linearly interpolates a compensation gain around a position of the pixel. The compensation gain calculation unit 143 calculates a compensation gain of the corresponding pixel.

The data modulation unit 144 multiplies the compensation gain of each pixel by the compensation data of each pixel. The data modulation unit 144 multiplies the compensation data of each pixel, to which the compensation gain is applied, by the input image data RGB. The data modulation unit 144 produces modulation image data RmGmBm to be displayed on the display panel 10 and then outputs it.

Figure 9:
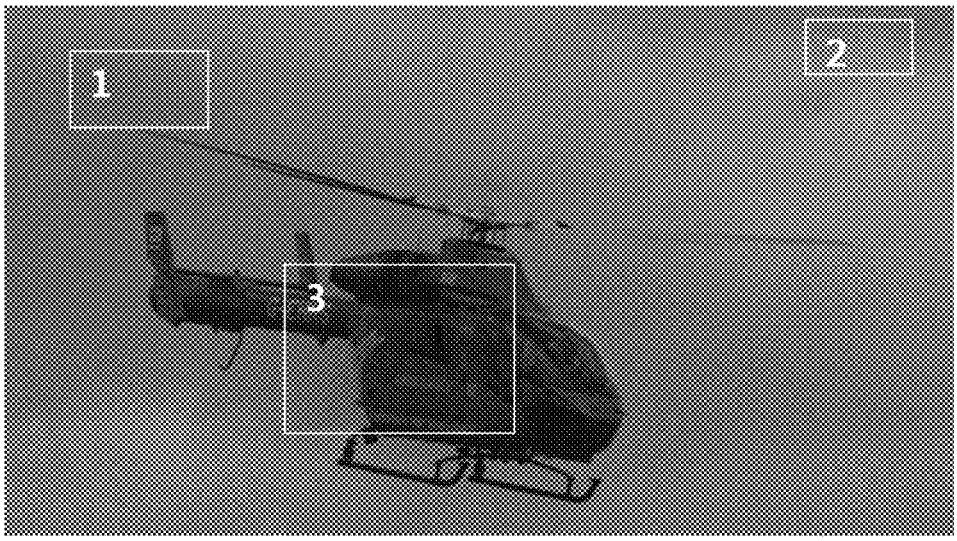
FIG. 9 illustrates an example of a test image to which an exemplary embodiment of the invention is applied.

FIG. 9 illustrates an example of a test image to which the embodiment of the invention is applied. FIG. 10 illustrates a luminance percentage based on a compensation image in each of additional compensation requirement areas Area1, Area2, and Area3 shown in FIG. 9.

Among the additional compensation requirement areas shown in FIG. 9, the Area3 includes a maximum amount of edge information, and the Area2 includes a minimum amount of edge information. The Area1 includes an amount of edge information which is more than the Area2 and is less than the Area3. The most complex image is displayed on the Area3, and the flattest image is displayed on the Area2. The embodiment of the invention causes all of the compensation gains applied to the additional compensation requirement areas to be less than '1'. In this instance, the embodiment of the invention sets the compensation gain to be applied to the pixels included in the Area3 to a relatively minimum value and also sets the compensation gain to be applied to the pixels included in the Area2 to a relatively maximum value based on the complexity of the image determined depending on an amount of edge information each of the additional compensation requirement areas includes. As shown in FIG. 10, luminance percentages based on the compensation image in the additional compensation requirement areas Area1, Area2, and Area3 through the differential adjustment of the compensation gains were 97.255%, 98.039%, and 87.059%, respectively. In the embodiment of the invention, a compensation gain of a reference compensation image is '1', and a degradation compensation percentage of the reference compensation image is 100%. Because the relatively complex image is displayed on the Area3, a compensation percentage and a luminance of the Area3 may be relatively reduced. Because the relatively flat image is displayed on the Area1 and the Area2, a luminance reduction in the Area1 and the Area2 may be conspicuous if the compensation gains of the Area1 and the Area2 are adjusted at the same level as the Area3. Thus, compensation percentages and luminances of the Area1 and the Area2 are set to be greater than the Area3.

Figure 11:
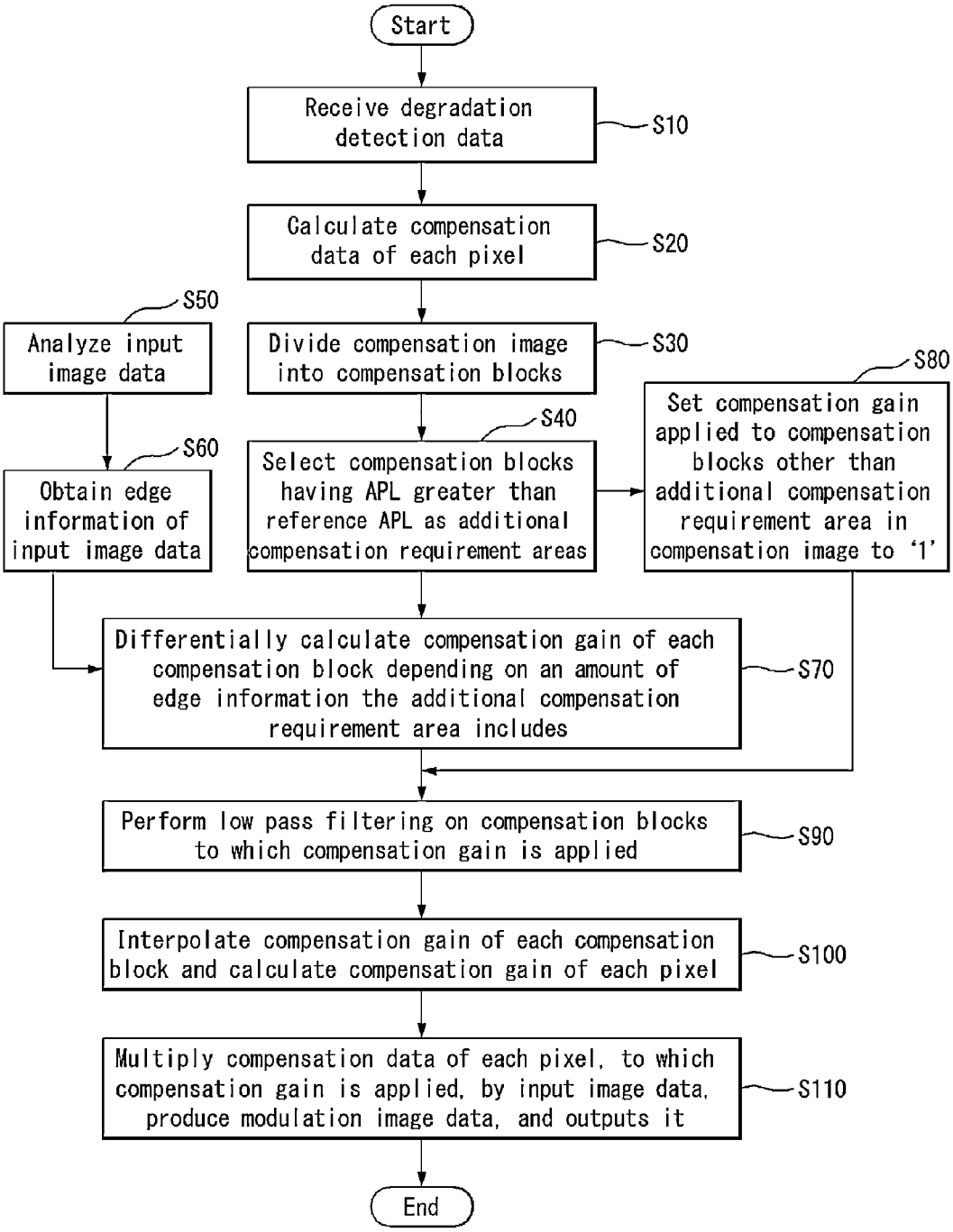
FIG. 11 sequentially illustrates a degradation compensation method of an organic light emitting display according to an exemplary embodiment of the invention.

FIG. 11 sequentially illustrates a degradation compensation method of the organic light emitting display according to an embodiment of the invention.

As shown in FIG. 11, the degradation compensation method of the organic light emitting display according to an embodiment of the invention receives degradation detection data indicating degradation degrees of the OLEDs from the display panel in step S10. The degradation compensation method calculates compensation data of each pixel for compensating for a luminance of each of the pixels included in the display panel based on the degradation detection data in step S20.

The degradation compensation method according to the embodiment of the invention divides a compensation image implemented by the compensation data into a plurality of compensation blocks and finds an APL of each compensation block in step S30. The degradation compensation method previously sets a reference APL and selects compensation blocks having an APL greater than the reference APL as additional compensation requirement areas for adjusting the compensation gain in step S40. The degradation compensation method analyzes input image data to be used in the adjustment of the compensation gain in step S50 and obtains edge information of the input image data in step S60.

The degradation compensation method according to the embodiment of the invention differentially calculates compensation gains of the compensation block within the range less than '1' depending on an amount of edge information the additional compensation requirement area includes in step S70. An equation for obtaining the compensation gain is expressed by the above Equation 1. The embodiment of the invention increases a scale constant k (refer to the above Equation 1) of a compensation block including much edge information and reduces the scale constant k of a compensation block including little edge information. Hence, the embodiment of the invention causes a compensation gain of a complex image to be less than a compensation gain of a flat image. The degradation compensation method sets a compensation gain of each of compensation blocks (i.e., averagely degraded compensation blocks), which are not selected as the additional compensation requirement area from the compensation image, to '1' in step S80.

The degradation compensation method according to the embodiment of the invention applies a low pass filter having a predetermined size to the compensation blocks, to which the compensation gain is applied, after the compensation gain of each compensation block is determined through the above-described process, thereby reducing a deviation between the compensation gains of the adjacent compensation blocks in step S90. The degradation compensation method interpolates the compensation gain of each compensation block and calculates a compensation gain to be applied to each pixel in step S100.

The degradation compensation method according to the embodiment of the invention multiplies the compensation data of each pixel, to which the calculated compensation gain is applied, by input image data, produces modulation image data to be displayed on the display panel, and outputs it in step S110.

As described above, the organic light emitting display and the degradation compensation method thereof according to the embodiment of the invention select the area which is more excessively degraded than the averagely degraded area, as the additional compensation requirement area and set the compensation gain to be applied to the additional compensation requirement area to be less than '1'. In this instance, a reduction width of the compensation gain varies depending on the complexity of the input image to be displayed in the additional compensation requirement area.

Accordingly, the embodiment of the invention causes the compensation gain to be less than '1', thereby reducing the compensation amount of degradation as compared to the related art. As a result, the embodiment of the invention prevents the rapid degradation of the OLEDs of the excessively degraded area through the compensation and reduces a difference between degradation speeds of all of the OLEDs on the display panel.

Furthermore, the embodiment of the invention greatly reduces the degradation compensation percentage as compared to 100% applied to the related art when the complex image is input to the excessively degraded area, thereby greatly reducing the luminance. The embodiment of the invention slightly reduces the degradation compensation percentage as compared to 100% applied to the related art when the flat image is input to the excessively degraded area, thereby slightly reducing the luminance. As a result, the embodiment of the invention causes the luminance reduction resulting from the compensation to be not recognized while reducing the degradation speed of the OLEDs.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangements within the scope of the disclosure, the drawings, the appended claims and their equivalents. In addition to variations and modifications in the component parts and/or arrangements, alternative uses will also be apparent to those skilled in the art.

What is claimed is:

1. An organic light emitting display comprising:

a display panel including a plurality of pixels each having an organic light emitting diode, the display panel displaying a visual image; and a degradation compensation circuit comprising:

a compensation area setting circuit to divide input image data into M×N compensation blocks, where M and N are integers greater than 0 and each compensation block corresponds to a group of pixels of the plurality of pixels, and select an additional compensation requirement area that includes compensation blocks corresponding to pixels that are more excessively degraded than those pixels in an averagely degraded area, based on degradation detection data indicating a degradation degree of the organic light emitting diodes of the plurality of pixels;

an edge information extraction circuit to analyze the input image data corresponding to the additional compensation requirement area and obtain edge information of the input image data, including a number of edges;

a compensation gain calculation circuit to calculate a compensation gain to be applied to compensation data in each of the compensation blocks in the additional compensation requirement area depending on the number of edges, and does not change the compensation data of each compensation block which is not in the additional compensation requirement area, wherein the compensation gain in the additional compensation requirement area is inversely proportional to the number of edges; and a data modulation circuit to multiply compensation data of each pixel, to which the compensation gain is applied, by the input image data and produce modulation image data to be displayed on the display panel.

2. The organic light emitting display of claim 1, wherein the compensation area setting circuit calculates the compensation data of each pixel for compensating for a luminance of each of the pixels based on the degradation detection data, wherein the compensation area setting circuit divides a compensation image implemented by the compensation data into the plurality of compensation blocks and finds the average picture level (APL) indicating an average brightness of each of the compensation blocks, wherein the compensation area setting circuit selects compensation blocks having an APL greater than a reference APL as the additional compensation requirement area for adjustment of the compensation gain.

3. The organic light emitting display of claim 1, wherein the compensation gain calculation circuit calculates the compensation gain of the compensation blocks within a range less than '1' based upon the number of edges the additional compensation requirement area includes.

4. The organic light emitting display of claim 3, wherein the compensation gain is obtained by the following Equation:

$$G(M, N) = \max\left[1 - \frac{k \times (APL(M, N) - Ref.\ APL)}{2^i}, Gmin\right]$$

where 'G(M,N)' is the compensation gain of each compensation block, 'k' is a scale constant, 'APL(M,N)' is an average picture level (APL), an average brightness, of each compensation block, 'Ref. APL' is a reference APL corresponding to brightness of the averagely degraded area, '$2^i$' is a maximum gray representation value determined depending on a number 'i' of bits of the input image data, and 'Gmin' is a minimum value of the compensation gain G (M,N) which is previously set to a fixed value so as to prevent the distortion of the image.

5. The organic light emitting display of claim 4, wherein the scale constant, k, increases in proportion to the number of edges in each compensation block.

6. The organic light emitting display of claim 1, wherein after the compensation gain of each compensation block is determined, the compensation gain calculation circuit applies a low pass filter to each compensation block in the additional compensation requirement area and reduces a deviation between the compensation gains of adjacent compensation blocks.

7. The organic light emitting display of claim 1, wherein the compensation gain calculation circuit interpolates the compensation gain of each compensation block and calculates a compensation gain to be applied to each pixel.

8. The organic light emitting display of claim 1, wherein the compensation gain calculation circuit calculates the compensation gain of the compensation blocks such that the compensation gain of the compensation blocks in the additional compensation requirement area which includes a larger number of edges becomes smaller than the compensation gain of the compensation blocks in the additional compensation requirement area which includes a smaller number of edges.

9. A degradation compensation method of an organic light emitting display, the organic light emitting display including a display panel having a plurality of pixels to display a visual image, the degradation compensation method comprising:

dividing input image data into M×N compensation blocks, where M and N are integers greater than 0 and each compensation block corresponds to a group of pixels of the plurality of pixels, and selecting an additional compensation requirement area that includes compensation blocks corresponding to pixels that are more excessively degraded than those pixels in an averagely degraded area, based on degradation detection data indicating a degradation degree of organic light emitting diodes in the plurality of pixels;

analyzing the input image data corresponding to the additional compensation requirement area and obtaining edge information of the input image data, including a number of edges;

calculating a compensation gain to be applied to compensation data in each of the compensation blocks in the additional compensation requirement area depending on the number of edges, and does not change the compensation data of each compensation block which is not in the additional compensation requirement area, wherein the compensation gain in the additional compensation requirement area is inversely proportional to the number of edges; and multiplying compensation data of each pixel in the additional compensation requirement area by the input image data and producing modulation image data to be displayed on the display panel.

10. The degradation compensation method of claim 9, wherein the selecting of the additional compensation requirement area includes:

calculating the compensation data of each pixel for compensating for a luminance of each of the pixels included in the display panel based on the degradation detection data;

dividing a compensation image implemented by the compensation data into a plurality of compensation blocks and finding an average picture level (APL) indicating an average brightness of each of the compensation blocks; and selecting compensation blocks having an APL greater than a previously determined reference APL as the additional compensation requirement area for adjustment of the compensation gain.

11. The degradation compensation method of claim 9, wherein the calculating of the compensation gain includes calculating the compensation gain of the compensation blocks within a range less than '1' based on the number of edges the additional compensation requirement area includes.

12. The degradation compensation method of claim 11, wherein the compensation gain is obtained by the following Equation:

$$G(M, N) = \max\left[1 - \frac{k \times (APL(M, N) - Ref.\ APL)}{2^i}, Gmin\right]$$

where 'G(M,N)' is the compensation gain of each compensation block, 'k' is a scale constant, 'APL(M,N)' is an average picture level (APL), an average brightness, of each compensation block, 'Ref APL' is a reference APL corresponding to brightness of the averagely degraded area, '$2^i$' is a maximum gray representation value determined depending on a number 'i' of bits of the input image data, and 'Gmin' is a minimum value of the compensation gain G(M,N) which is previously set to a fixed value so as to prevent the distortion of the image.

13. The degradation compensation method of claim 12, wherein the scale constant increases in proportion to the number of edges in each compensation block.

14. The degradation compensation method of claim 9, further comprising:

after the compensation gain of each compensation block is determined, applying a low pass filter to each compensation block in the additional compensation requirement area and reducing a deviation between the compensation gains of adjacent compensation blocks; and interpolating the compensation gain of each compensation block and calculating a compensation gain to be applied to each pixel.

15. The degradation compensation method of claim 9, wherein the calculating of the compensation gain calculates the compensation gain of the compensation blocks such that the compensation gain of the compensation blocks in the additional compensation requirement area which includes a larger number of edges becomes smaller than the compensation gain of the compensation blocks in the additional compensation requirement area which includes a smaller number of edges.

* * * * *